United States Patent [19]

Bankes et al.

[11] 4,262,805

[45] Apr. 21, 1981

[54] DISTINGUISHING ELONGATED ARTICLES ACCORDING TO THEIR SHAPE

[75] Inventors: Kristen E. Bankes, Reading; Carl H. Herman, Fleetwood; Anderson F. Johnson, Jr., Sinking Spring; Donald M. Large, Temple, all of Pa.

[73] Assignee: Western Electric Company, Inc., New York, N.Y.

[21] Appl. No.: 65,031

[22] Filed: Aug. 9, 1979

[51] Int. Cl.[3] ..... B07C 9/00

[52] U.S. Cl. ..... 209/656; 209/907; 209/940

[58] Field of Search ..... 209/539, 598, 606, 656, 209/658, 904, 907, 911, 940

[56] References Cited

U.S. PATENT DOCUMENTS

| | | | |
|---|---|---|---|
| 2,805,898 | 9/1957 | Willis, Jr. | 209/906 X |
| 3,180,490 | 4/1965 | Fischer | 209/598 |
| 3,537,580 | 11/1970 | Beroset et al. | 209/907 X |
| 3,581,890 | 6/1971 | De Muzio et al. . | |
| 3,623,604 | 11/1971 | Roberts | 209/598 X |
| 3,710,935 | 1/1973 | Heiser | 209/598 X |

FOREIGN PATENT DOCUMENTS

| | | | |
|---|---|---|---|
| 197711 | 11/1977 | U.S.S.R. | 209/940 |

*Primary Examiner*—Robert J. Spar
*Assistant Examiner*—Edward M. Wacyra
*Attorney, Agent, or Firm*—D. C. Watson; G. W. Houseweart

[57] ABSTRACT

Elongated articles (13), having an undesirable shape caused by a bent lead (14), are distinguished from elongated articles (12) which are desirably straight. The bent articles (13) are separated from a mass of articles (12 and 13), most of which are substantially straight. The articles (12 and 13) are typically axially leaded diodes having leads (14) which are magnetic. Such diodes (12 and 13) are successively introduced between sidewalls (11 and 22) of a bin (17) having a magnetic field which orients each article transverse to guide members (28 and 29) extending lengthwise of the bin (17). Each oriented diode (12 and 13) presents a distinctive configuration according to its shape when viewed against a plane transverse to the guide members (28 and 29). The major portion of a bent diode (13) will be disposed lower than the major portion of a straight diode (12). The diodes (12 and 13) are advanced in succession along the guide members (28 and 29) and the configurations of the diodes (12 and 13) form substantially parallel pathways through the bin (17). An interposing and separating mechanism (34) is located in the bin (17) adjacent to the pathways of the diodes (12 and 13). The mechanism (34) interposes at least one member (32) between the pathway of a diode (12) which is substantially straight and the pathway of a diode (13) which is unacceptably bent. The bent diode (13) strikes the interposed member (32) and becomes disoriented in the magnetic field of the bin (17). The bent diode (13) falls away from the guide members (28 and 29) and is drawn downwardly through an exit port (18) into an exit chute (44) which has a magnetic field to orient the diode (13). The straight didode (12) passes over the interposing member (32) and continues to advance along the guide members (28 and 29) to an outlet end (21) of the bin (17).

20 Claims, 8 Drawing Figures

DISTINGUISHING ELONGATED ARTICLES ACCORDING TO THEIR SHAPE

TECHNICAL FIELD

This invention relates to distinguishing between various elongated articles according to their shape. More particularly, the invention relates to distinguishing between elongated articles, such as axially leaded diodes, having bent leads and such articles having straight leads. The invention has been found to be useful in the detection and removal of a few such articles having bent leads from a large number of such articles, the great majority of which have leads which are substantially straight.

BACKGROUND OF THE INVENTION

Elongated electrical articles, such as varistors, capacitors and diodes, of the types known as axially leaded devices, are currently mass produced in high speed production lines. Typically, these articles have two wire-like leads extending in longitudinally opposite directions from a central, generally cylindrical, body portion. The leads of these axially leaded devices are quite susceptible to being bent or deformed in the course of manufacture of the respective articles.

However, it is advantageous to have the leads of axially leaded devices nearly straight for further processing involving mass handling techniques. For example, axially leaded diodes typically are sorted and tested while they are being carried in a parallel array on a conveyor or wheel. Furthermore, since labor saving machinery is used to automatically insert such devices into printed circuit boards used in computers, test sets, and similar equipment, it is important that the leads of such devices be nearly collinear for end use. Otherwise, the automatic insertion machinery can fail to properly manipulate the devices.

Various machines are commercially available to straighten bent leads of axially leaded devices. Moreover, these machines do an effective job of straightening such bent leads, especially at medium to low rates of production. It has therefore become customary for manufacturers to run all the devices through lead straightening as a preventative measure after the devices are assembled and before such devices are further processed.

It has been recognized, however, that typically only a small percentage of the assembled devices have leads which are unacceptably bent. Thus, it has been customary to treat all the devices for a problem which exists in only a few such devices. This is a problem in that the treatment is costly and is known to ruin some good devices, especially at the high rates of production required in the industry today.

It would be far better, after the devices are assembled, to detect the devices which are defective because of bent leads and to separate such defective devices from good devices having straight leads. The large majority of good devices could then be processed without the expense of lead straightening and without the risk to such good devices.

Various efforts have heretofore been made to visually detect bent leads and to manually remove bent leaded devices from a flow of axially leaded devices in a production line. However, these efforts have proven to be rather costly and are generally effective only when the leads are excessively bent.

The presently known attempts to mechanically solve the problem of bent leads have been associated with an individual process such as the sorting or the testing of devices. For example, drums which are used to transport and to test axially leaded devices have employed grooves or slots on the periphery thereof which are purposely made very shallow. Bent leaded devices cannot readily become seated in such shallow grooves, so generally only straight leaded devices are picked up by the drum.

As another example, U.S. Pat. No. 3,581,890 to D. D. DeMuzio et al. discloses an indexable drum for testing and sorting axially leaded diodes. A pair of cams with curved ends are provided adjacent to either side of the drum, the curved ends being positioned to engage leads which are excessively bent. After bent leads are engaged, the diodes having such leads are deflected off the drum. The diodes are therefore removed if their leads are bent but the described apparatus has been found not to be readily adaptable to high speed production.

SUMMARY OF THE INVENTION

In view of the foregoing, it is an object of this invention to provide methods and apparatus for distinguishing elongated articles having a first shape from elongated articles having a second shape.

It is another object of this invention to provide methods and apparatus for separating such elongated articles according to their shape.

With these and other objects in mind, the present invention includes orienting elongated articles transverse to a longitudinal guiding means in such a way that the articles present distinctive configurations of the first and second shapes when viewed against a plane transverse to the guiding means. The articles are advanced in succession in the direction of the guiding means so that the configurations of the first and second shapes thereby form substantially parallel pathways. At least one member is interposed in the space between the parallel pathways to separate and therefore to distinguish the articles according to their shapes.

In another and preferred embodiment of the invention, wherein the articles are magnetic, the orienting further comprises successively introducing the articles between spaced sidewalls of a magnetic bin. There is established between and transverse to the sidewalls of the bin a magnetic field of sufficient strength relative to the weight of the articles to suspend each article between the sidewalls at a position relative to a plane of balanced magnetic forces between said sidewalls.

BRIEF DESCRIPTION OF THE DRAWING

Other objects and advantages of the invention will be more readily understood from the following detailed description when read in conjunction with the accompanying drawing, wherein.

Figure 1:
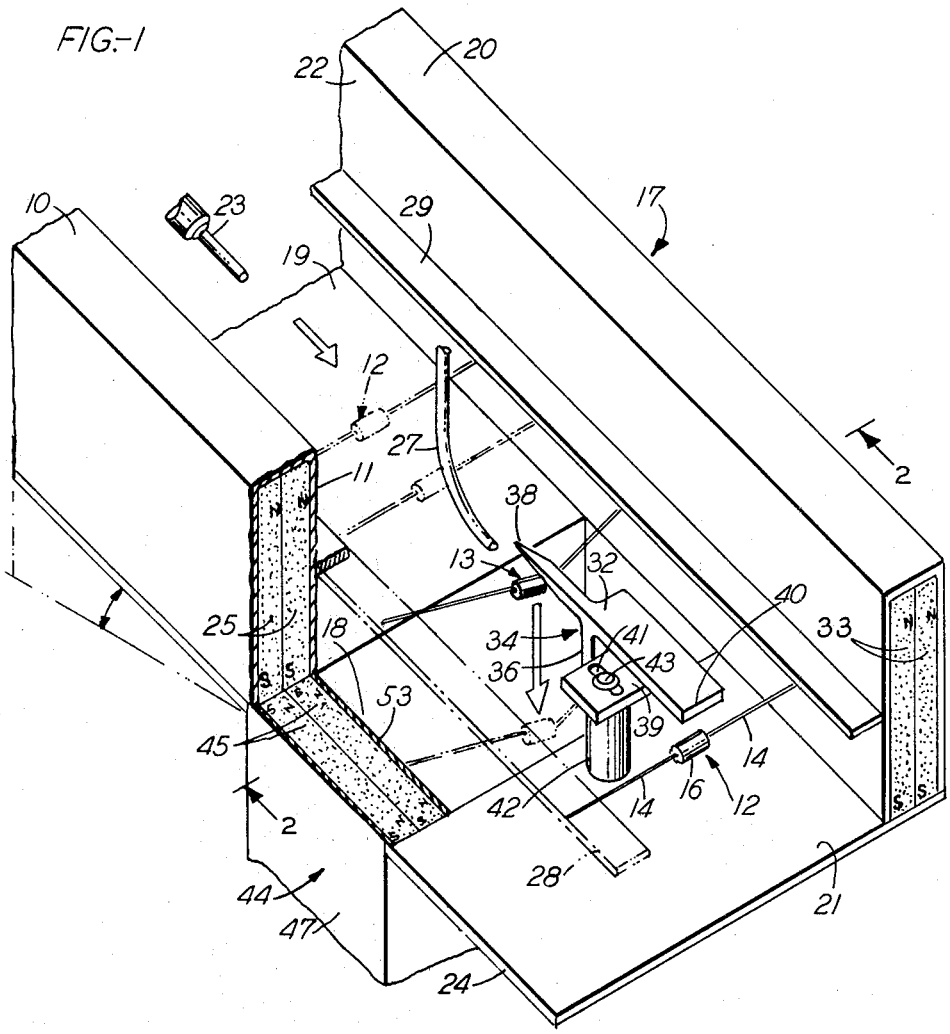
FIG. 1 is a pictorial view of a magnetic bin illustrating a preferred embodiment of the instant invention.

For clarity and to promote a better understanding of the invention, the various figures are schematically simplified to highlight various features of the invention. Also, where appropriate, the same reference numerals have been repeated in the various figures to designate corresponding features in the drawing.

DETAILED DESCRIPTION

THE ELONGATED ARTICLES

In FIG. 1 there are shown several articles 12 and articles 13 which are to be distinguished and separated according to their respective shapes as will be described in more detail hereafter. For purposes of illustration, the articles 12 and 13 will be identified and referred to as axialy leaded diodes. However, it will be appreciated that any of a number of axially leaded articles, such as varistors, diodes or capacitors can as well be distinguished and separated in accordance with this invention.

Referring again to FIG. 1, the diodes 12 and 13 have wire-like leads 14 which extend in opposite directions from a central body 16. Diodes 12 have desirably straight or axially symmetrical shapes, while diodes 13 have leads 14 which are bent away from a theoretical straight axis drawn through the bodies 16 of such diodes. Diodes 13 advantageously are separated from diodes 12 to facilitate subsequent handling by automatic apparatus. It should be realized, however, that under specific circumstances, articles having a curved, bent or otherwise axially asymmetrical shape may be the desired article. In such a case it would then be desirable to separate the straight articles such as the diodes 12 from a larger number of diodes 13 in order to process or further handle the remaining bent or curved diodes 13. Such further handling may include further separating the diodes 13 according to the degree of desirable or undersirable shape of their leads 14.

ORIENTING THE ARTICLES

Elongated articles such as diodes 12 and 13 are so light and resilient that they are quite difficult to handle unless they are all oriented in a given direction. Generally the leads 14 are made of a magnetic material, i.e., a material which is attracted to a magnet. It is therefore advantageous to use a magnetic means to orient the diodes 12 and 13 as a first step in a method of separating the articles.

In FIG. 1 there is shown a pictorial view of a magnetic bin 17 illustrating a preferred embodiment of the instant invention for orienting and separating the articles. The bin 17 is a mechanical assembly of two spaced side members 10 and 20 joined to a floor member 24 to form a rectangular channel useful for handling diodes 12 and 13. The sidemembers 10 and 20 have confronting sidewalls 11 and 22, respectively, which are typically spaced apart a distance slightly greater than the length of a diode 12 measured between the outer tips of the leads 14. For example, given a diode 12 having an overall length of $3\frac{3}{8}$ inch, the distance between the sidewalls 11 and 22 may be set at 3-7/16 inch. This setting provides suitable fabrication tolerances for both the diodes 12 and the bin 17. The bin 17 is made sufficiently long to accommodate an exit port 18, shown in the floor member 24, and to further convey the articles to a subsequent process or to a storage bin. The sidemembers 10 and 20 of the bin 17 support a system of permanent magnets 25 and 33 which are shown in more detail in FIG. 2, a cross-sectional view of bin 17 taken along line 2—2.

Figure 2:
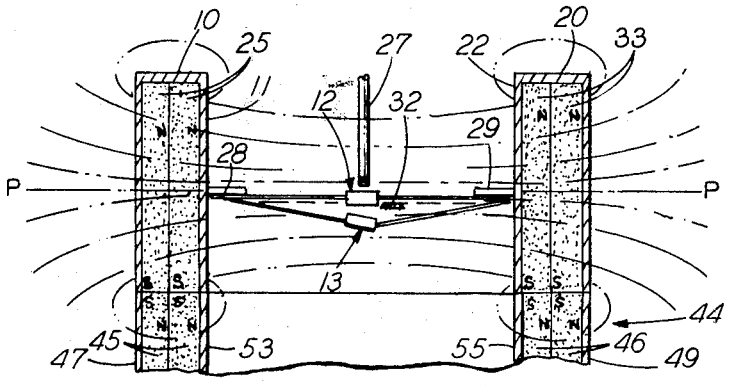
FIG. 2 is a cross-sectional view of the magnetic bin shown in FIG. 1 taken along line 2—2.

To illustrate an arrangement of magnets which is easily obtained, the system of magnets, as shown in FIG. 2, includes two magnets 25 placed together in the sidemember 10 and two magnets 33 placed together in the sidemember 20. The material selected for the magnets 25 and 33 is advantageously one having good resistance to demagnetization, e.g., barium ferrite. Such ferrite materials are now incorporated either into ceramics or into plastics to produce permanent magnets having high residual magnetization and high magnetizing power per unit of length between the poles.

The magnets 25 and 33 are provided in the form of flat bars with each entire face of a bar being of the same magnetic polarity. Note that the thickness of the flat bar magnets 25 and 33 is in reality the "length" of each magnet, the length being defined as the distance between the poles. Flat bar magnets of $\frac{3}{8}$ to $\frac{1}{2}$ inch in thickness are commercially available and the necessary strength of the magnetic field which is desired between the sidewalls 11 and 22 can be obtained by mating such flat bar magnets together as shown in FIG. 2. The magnetic field generated thereby must be of sufficient strength relative to the weight of the diodes 12 and 13 to suspend them as shown above the floor 24 and between sidewalls 11 and 22 of the bin 17.

In a preferred example, which will be used hereinafter unless otherwise specified, a typical diode 12 is selected which measures about $3\frac{3}{8}$ inches long and weighs about 0.2430 grams. The distance between the sidewalls 11 and 22 is set at about 3-7/16 inches, which provides an air gap between the faces of the magnets 25 and 33 of about 3-9/16 inches, the difference being the combined thickness of the sidewall sheet materials. For these conditions a molded plastic, permanent magnet material such as that sold by 3M Company of Minneapolis, Minnesota under the trade designation "Plastiform PL-1 or PL-1H" is selected. Two sections of this material, each about $\frac{3}{8}$ inch thick, when mated together provide a composite magnet 25 or 33 which is about $\frac{3}{4}$ inch thick. When such a composite magnet 25 and a similar magnet 33 are confronted in a spaced relationship they form an adequate magnetic field to orient and suspend the diodes 12 transverse to the sidewalls 11 and 22 in a manner suitable to practice the invention.

Figure 3:
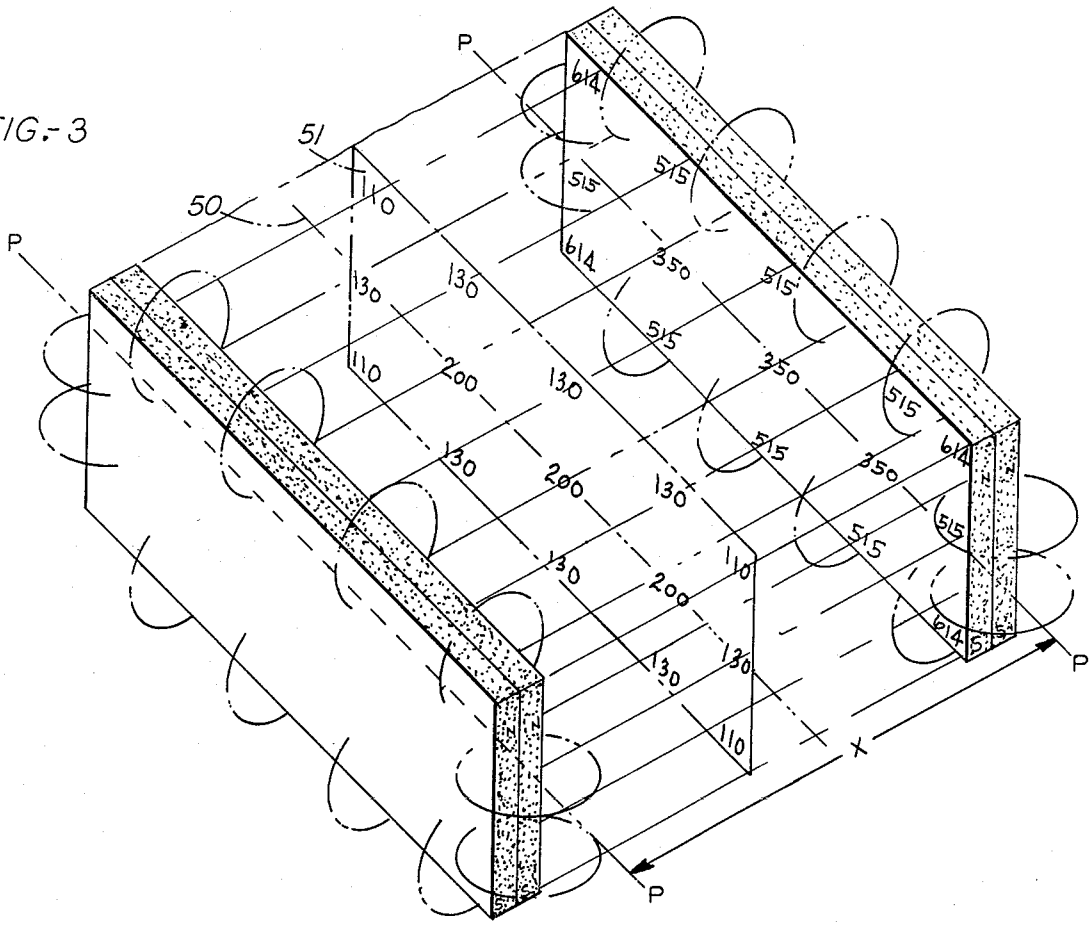
FIG. 3 is a pictorial view of a magnetic system for a bin similar to the bin shown in FIG. 1.

In FIG. 3 there is shown a magnetic system which is adapted to suspend and orient longer diodes than the diodes 12 mentioned described above as the preferred example. However, data is available for the system shown in FIG. 3 and it is therefore useful for explaining the detailed features of a magnetic field which is typical of that used in a bin similar to the bin 17.

For diodes which are about 4-7/16 inches long, two sections of $\frac{1}{2}$ inch thick permanent magnet material are selected and the two sections are mated together to form a set of magnets which total about 1 inch in thickness. Two such sets of magnets are set apart as shown to provide an air gap of width "X" equal to about $4\frac{5}{8}$ inches. Each set of magnets presents a south pole face which communicates with the other set of magnets presenting a north pole face to form a magnetic field therebetween. Such communication takes place along flux lines between the two confronting sets of magnets. However, not all of the flux lines communicate across the air gap; some flux lines preferentially return to the rear pole of each set of magnets, thus leaking magnetic force from the arrangement.

The numerical values noted on the south pole face of the set of magnets, which appear on the righthand side of FIG. 3, are typical readings of flux densities taken about 0.25 inch away from the south pole face. The differences in the values can be explained by noting the paths available for magnetic flux to communicate with a north pole, since such communication is inherent in magnetic fields. For example, the flux density readings in Gauss at the corners are higher than anywhere else on the south pole face. These readings are higher because there are many short return paths available from the corners to the rear, north pole of the righthand set of magnets. In addition, flux from such corner areas communicates along the longer paths across the air gap to the confronting north pole of the lefthand set of magnets. Note, however, that the flux density readings in the middle of the south pole face are much lower because the paths for flux to return to the rear, north pole of the righthand set of magnets are very long. In fact, it is found that most of the flux from the middle of the south pole face will preferentially cross the air gap to the north pole of the lefthand set of magnets in the arrangement shown.

Now observe similar flux density readings taken on a vertical plane 51 which has been theoretically interposed halfway between the sets of magnets in the air gap. Note that the corner readings are the lowest and that the middle readings are the highest. Furthermore, the high, middle readings, e.g., 200, are repeated extending lengthwise of the magnetic field. It has thus been observed that the magnetic forces are balanced about a plane designated as P—P which extends lengthwise of and intersects both sets of magnets at about their longitudinal centerlines as shown in FIG. 3. It has been further observed that light, elongated articles such as diodes 12 and 13 tend to become suspended along and about plane P—P if the magnetic field is strong enough to support such articles. The flux readings taken on the plane 51, measured along a line 50 where plane P—P intersects plane 51 are found to be the clearest indication of whether the field will adequately suspend the articles along plane P—P. An excellent discussion of these observations appears in an article entitled "Magnetic Suspension Parts Handling," *The Western Electric Engineer,* July 1967, Vol XI, No. 3, pp, 36–42 and is hereby incorporated herein by reference.

When the diodes 12 and 13 are successively introduced into the magnetic bin 17 as shown in FIG. 1, they become oriented transverse of the sidewalls 11 and 22. If the magnetic field is of sufficient strength relative to the weight of the diodes 12 and 13 they become suspended between the sidewalls 11 and 22 at about the center of the magnets 25 and 33. It has been found that when a diode 12 is repeatedly removed and again suspended along the length of the bin 17, the ends of the leads 14 repeatedly traverse essentially the same path, with a deviation in a range of only about 0.06 to 0.08 inches. The degree of such deviation, of course, is an indication of the precision with which the diodes 12 can be oriented in the field and the path traversed provides a rough indication of the plane P—P of balanced forces in the magnetic field. Actually, such plane P—P is slightly above the path because the weight of the diodes 12 cause them to be suspended lower than the plane P—P. If the magnets are of homogeneous physical content, and if they are uniformly rectangular, the plane P—P of balanced forces typically will be found to lie along the geometric midline of the rectangular faces of such confronting magnets 25 and 33.

Again referring to FIG. 2, flux lines are drawn to indicate the features of the magnetic field established in the background, i.e., near the input end 19 of the bin 17. It can be seen that the flux lines caused by the magnets 25 and 33 are symmetrically balanced about the plane P—P which intersects the sidewalls 11 and 22 at about the middle thereof. Note also that guide members 28 and 29 are affixed to the sidewalls 11 and 22 so that the undersides of the members 28 and 29, which serve as a longitudinal guiding means, are below the plane P—P. When the diodes 12 and 13 are successively introduced between the confronting sidewalls 11 and 22 and under the members 28 and 29, the ends of the leads 14 of the diodes 12 and 13 are urged upward against the guide members 28 and 29 and tend to adhere thereto. Such arrangement provides a very fine method of orienting the articles in a plane transverse to the longitudinal guiding means. The ends of the articles are held in place by the bias created between the magnetic field, which tends to pull the articles toward the plane P—P, and the guide members 28 and 29 which tend to restrain the ends of such articles at the undersides of such members. Further, the force of gravity causes the major portion of a bent diode 13 to hang lower than the major portion of a straight diode 12. Thus the oriented articles present distinctive configurations of their shapes when viewed against a plane transverse to the guiding means. Of course the bias created by the cooperation between the magnetic field and the guide members 28 and 29 varied by, among other things, adjusting the distance between the plane P—P and the undersides of the guide members 28 and 29, all of which will be explained more fully below.

ADVANCING THE ARTICLES

As each diode 12 or 13 is introduced in succession into the bin 17, shown in FIG. 1, such diode is advanced along the undersides of the guide members 28 and 29 in the direction in which the guide members 28 and 29 extend lengthwise of the bin. The means for advancing the articles may cause the ends of the articles to stray below guide members 28 and 29. Also if both ends of an article do not advance in a uniform manner the orientation transverse to the guiding means will be disturbed. Furthermore, the speed at which each article is advanced bears on the high rate of production desired in the industry today.

As explained previously, the magnetic field is of uniform force along the plane P—P of the bin 17. Therefore, when the bin 17 is inclined as shown in FIG. 1 from an inlet end 19 downwardly to an opposite or outlet end 21, the articles are urged by the force of gravity to advance along plane P—P through the bin 17. Of course, the bias created between the plane P—P and the undersides of the guide members 28 and 29 tends to slow the articles because such bias causes the ends of the articles to adhere to the guide members 28 and 29 and friction forces are developed therealong.

Inasmuch as the force of gravity available for advancement is of limited intensity, such friction forces should be adequately and smoothly overcome if uniform advancement of both ends of the articles is to be achieved.

The force of gravity is usefully employed to advance the articles because it is of steady and uniform intensity. A steady motive force is desirable because pulsations can interfere with the article orientation. Furthermore, the articles are of closely uniform weight so the force of gravity advances the articles at a nearly uniform rate of speed through the bin 17. The rate of speed desired taken with the adverse forces of friction determine the pitch at which the bin 17 is inclined. The pitch is here defined as the angle that the inclined bin 17 forms with a horizontal plane, expressed in degrees. It has been found that a pitch of about 15 degrees is preferred for the example explained above using $3\frac{3}{8}$ inches long diodes; however, a different pitch can be applied to the bin 17 without serious interference with the operation of the invention.

It should be apparent, however, that the more the bin 17 is inclined, the less easy it is to distinguish between a bent diode 13 and a straight diode 12. This adverse effect can be explained by referring to FIG. 2 which is a cross-sectional view of the bin 17 and therefore facilitates visualization of a plane transverse to the longitudinal guiding means. It will be appreciated that a bent diode 13 always hangs vertically regardless of the inclination of the bin 17. For this reason, a bent diode 13 appears farther away from plane P—P when the bin 17 is horizontal than when the bin 17 is steeply inclined. Thus, when the bin 17 is steeply inclined there is less space between the path traversed by a bent diode 13 and the path traversed by a straight diode 12, and it becomes more difficult to interpose a separating member between the pathways of the articles. Accordingly, the articles are most easily distinguished according to their shape with precision when the bin 17 is horizontal.

To minimize the forces required to advance the articles at the desired rate of speed, the frictional forces can be reduced by adjustably increasing the distance between the plane P—P and the undersides of guide members 28 and 29. Such adjustment will reduce the frictional forces by decreasing the normal forces which bias the ends of the articles toward the guide members 28 and 29. Of course, the ends of the articles are then more likely to stray from the undersides of guide members 28 and 29 so an accommodation must be made between the precision of the work and the forces available to advance the articles. If faithful adherence to the guide members 28 and 29 is considered desirable or if the bin 17 is to be held precisely horizontal, another motive force can be used to either supplement or to replace the force of gravity in advancing the articles.

Again referring to FIG. 1, a jet 23 is shown at the inlet end 19 of the bin 17. The jet 23 is used to direct at least one stream of a fluid such as, for example, compressed air, against the articles to further the advancement of such articles along the guiding means. When only one jet 23 is used to direct only one stream of air against each successive diode 12 or 13 the stream of air is advantageously directed against the body 16 of such diode and the body 16 is pushed along the centerline of the bin 17. Furthermore, it has been found advantageous to advance only one article at a time through the bin 17 to prevent collisions between the articles. It is also advisable to employ a steady source pressure of compressed air so jet 23 will deliver a steady stream of air without pulsations. Such pulsations are detrimental because they tend to cause the articles to bounce in the magnetic field whereby the ends of such articles tend to stray from the undersides of the guide members 28 and 29.

It will be appreciated that either the inclination of the bin 17 or the force of air pressure can be varied as explained to suit the articles and the various considerations mentioned. It is also evident that other means can be employed for advancing the articles. For example, the articles can be advanced by using a magnetic field having a flux density which varies increasingly from the inlet end 19 to the outlet end 21 of the bin 17. Articles placed in such a varying magnetic field at an end having a low flux density tend to be drawn toward the opposite end of the field having a high density. One simple way of creating such a field is merely to vary the air gap between the confronting sets of magnets 25 and 33 so the gap decreases in the direction toward which the articles are to be advanced.

INTERPOSING A MEMBER TO SEPARATE THE ARTICLES

In view of the foregoing, it should be apparent that, as the articles are advanced in succession along the longitudinal guiding means in the bin 17, the configuration of each article forms a pathway through the bin 17. Each article having a different configuration forms a different pathway, but the pathways are nevertheless substantially parallel to one another because each article advances along the same longitudinal guiding means. It is the pathway formed by an article having a specific configuration or shape which provides a basis for separating the articles. For the purposes of this description the configuration of a substantially straight diode 12 provides a basis for distinguishing straight diodes 12 from bent diodes 13.

As can be seen in FIG. 1, an exit port 18 is located in the floor 24 of the bin 17. Immediately adjacent to the exit port 18 there is also mounted to the floor 24 an interposing and separating mechanism 34. Although the mechanism 24 is used to remove articles having various degrees of an undesirable shape, it is especially suited to distinguish between very straight diodes 12 and only slightly bent diodes 13, i.e., the mechanism can distinguish between the diodes based on a fine degree of difference in their shape.

The mechanism 34 includes a member 32, a deflection arm 36 and an adjustable stand 42. Note that the member 32 tapers in a knife-like manner from a wide support end 40 to a leading edge 38. As viewed in FIG. 1, the top and near sides of member 32 advantageously are flat and a taper is formed along the bottom surface and along the far side surface thereof. An arm 39 extends from the member 32 to the stand 42 where a slot 41 and a screw 43 are provided to permit adjustment of member 32 when the arm 39 is connected to the stand 42. Also, the stand 42 can be varied in height to vertically adjust the position of the member 32.

As can be clearly seen in FIG. 1, the interposing member 32 is positioned to the far side of the centerline of the bin 17. The vertically flat, near side of the member 32 is positioned to just clear the far side of a body 16 of a straight diode 12 as it advances to the mechanism 34. The horizontally flat, top side of the member 32 is positioned to just clear the bottom of a lead 14 of straight diode 12. In FIG. 2 it can be seen that a bend in a lead 14 of a diode 13 causes the body 16 to be slightly tilted and both the body end of the leads 14 and the body 16 are lowered by the force of gravity. Note also that the overall straight distance between the tips of the leads 14 of a bent diode 13 becomes foreshortened by the bend in the lead 14. Therefore the tips of the leads of a bent diode 13 are not so closely disposed to the sidewalls 11 and 22 as are the tips of the leads 14 of a straight diode 12. Is is well known that the flux in a magnetic field preferentially seeks paths through a magnetic material such as the leads 14. The flux lines tend to distort toward the leads 14 on either end of a diode 12 or 13 and thus become supportive of such a magnetic article. It is further known that the closer a magnetic article can be disposed to a magnetic pole, the stronger is the attractive force exerted upon the article. It is not surprising then to find that the tips of the leads 14 are usually disposed lower below the undersides of guide members 28 and 29 for a bent diode 13 than for a straight diode 12 because of the weaker attractive force working on the diode 13 caused by the foreshortening mentioned.

The leading edge 38 of the member 32 is made fine so it can be interposed between the pathway of a straight diode 12 and the pathway of a diode 13 which is only slightly bent. Typically a wire-like lead 14 is about 0.020 inch in diameter. Therefore, if a diode 12 advances precisely along the undersides of guide members 28 and 29 to the interposing member 32, and if no allowance is made for clearances, the flat, topside of the member 32 could be set just a little more than 0.020 inch below the undersides of the guide members 28 and 29. In practice it is advisable to set the flat, top side of member 32 about 0.07 inch below the undersides of the guide members 28 and 29 to allow for clearances. Thus a diode 13 will not then be separated from a mass of articles moving through the bin 17 unless one of its leads 14 is bent more than about 0.10 inch from an axial line drawn through its body 16. It is to be understood, however, that those dimensions are only offered to describe a practical setting for the member 32 when given the clearances mentioned. Other settings can be made to usefully cull out articles having various types and degrees of bending in the leads 14.

Again referring to FIGS. 1 and 2, an exit chute 44 is shown affixed to the bottom member 24 of the bin 17. The receiving end of the chute 44 is aligned with the exit port 18 and the major portion of the chute, consisting of two spaced side members 47 and 49, projects downwardly away from the bin 17. A set of magnets 45 is provided in the side member 47 and a similar set of magnets 46 is provided in the side member 49. Such side members 47 and 49 are abutted on their upper ends to the bottoms of side members 10 and 20 respectively of the bin 17. The chute 44 is therefore disposed so the sidewall 11 of the bin 17 is in the same plane as a sidewall 53 of the chute 44 and the sidewall 22 of the bin 17 is similarly in the same plane as a sidewall 55 of the chute 44.

A magnetic field is established between and transverse to the sidewalls 53 and 55 of the chute 44 by the magnets 45 and 46. The field in chute 44 has lines of force which run parallel to the lines of force in the magnetic field of the bin 17. The magnetic field in the chute 44 has an interactive effect on the magnetic field in the bin 17 which causes articles which are deflected downwardly into the exit port 18 to be received into the chute 44. It is thought that the interactive effect causes the lines of flux at the bottom of the bin 17 to be more linear and more evenly distributed than those shown in FIG. 2, i.e., those lines near the input end 19 of the bin 17. The result of the interactive effect is that the downwardly deflected articles are attracted into the exit chute 44 and the orientation of the articles is established transverse to the sidewalls 53 and 55. In practice the bottom end (not shown) of the chute 44 can be directed to a magnetic bin which feeds a lead straightening machine or to a storage bin.

In operation of the invention, as shown in FIGS. 1 and 2, the diodes 12 and 13 are advanced in succession to the interposing and separating mechanism 34 at a speed suitable for production and also at a speed suitable to cause a significant collison of a bent diode 13 with the mechanism 34. If a diode 13 is excessively bent it will hang low when it collides with mechanism 34 and a significant collision will not necessarily be required to cause such diode 13 to be pulled downward and out of the magnetic field of the bin 17. However, a slightly bent diode 13 strikes upon the tapered surfaces of member 32 and the diode 13 is guided downward along such surfaces causing frictional force to develop therealong. It therefore requires more advancing force to remove only slightly bent articles to overcome the said frictional forces.

It is found that a significant collision between a bent diode 13 and the member 32 causes such diode to be pulled downwardly away from the undersides of the guide members 28 and 29 sufficiently so the diode becomes disoriented from the flux lines crossing the bin 17. The diode 13 then strikes the deflection arm 36 and falls through the exit port 18 and out of the bin 17. Of course, a straight diode 12 does not collide with the member 32 but passes over the flat, top side of the member 32. Such diode 12 is advanced through the bin 17 and out the end 21 either to storage or to a subsequent process.

The speed required to obtain the significant collision required between a bent article and the member 32 to cause removal of the bent article is not easily quantified. However, as mentioned previously, an inclination of about 15 degrees in the bin 17 will adequately supply the gravitational force necessary to remove the diodes 13 described herein in the preferred example. When the bin 17 is so inclined and a bias distance of about 0.060 inch to about 0.120 inch is set between plane P—P and the undersides of guide members 28 and 29 a collision occurs between a diode 13 and member 32 which is significant enough to cause the diode 13 to be deflected downward through the exit port 18. It is to be understood, however, that various settings of the bin inclination, of the bias distance, of the member 32 and changes in the magnetic system can be made to accommodate various articles. It is believed that such settings and changes can easily be ascertained by one of ordinary skill in the art in practicing the invention.

It has been observed that an article which is only marginally bent may adhere to the top side of the member 32 if the clearances are not properly allowed or if the advancement force is insufficient. It is therefore advisable, when setting the member 32 close to the pathway of a straight diode 12, to direct a stream of a fluid such as, for example, compressed air from a jet 27 upon the area of the mechanism 32 as the articles advance thereto, to prevent the articles from adhering to the member 32 and thereby to prevent articles from accumulating in the area.

ALTERNATE EMBODIMENTS

Figure 4:
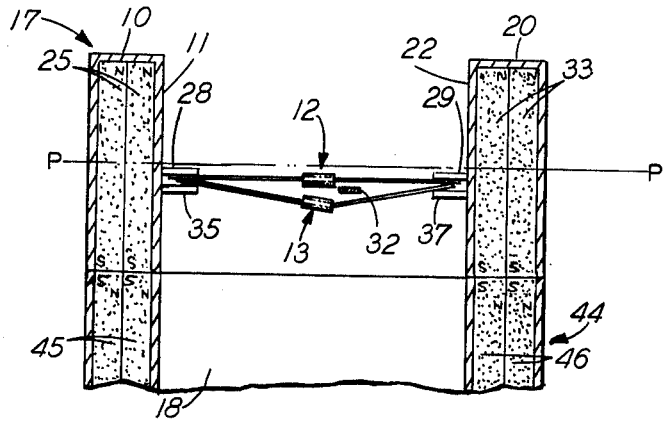
FIG. 4 is the same view as FIG. 2 except that additional guiding members are included.

Irregularities which sometimes occur when the articles are introduced into the bin 17 can cause the articles to bounce in the magnetic field. It has also been mentioned that pulsations of air from the jet 23 located at the end 19 of the bin 17 can cause the articles to bounce whereby the ends of such articles will stray from the undersides of guide members 28 and 29. It is therefore useful to limit the distance over which the ends of an article can stray by modifying the guiding means as shown in FIG. 4. The view shown in FIG. 4 is the same crosssectional view of the bin 17 shown in FIG. 2 except for the modifications to the guiding means. Note that other members 35 and 37 are affixed to each sidewall 11 and 22 just below and spaced from the guide members 28 and 29. Care must be exercised in setting the limiting distance between the guide members 28 and 29 and the limiting members 35 and 37 because excessively bent diodes 13 may become jammed along the undersides of guide members 28 and 29 if the space provided for the ends of the leads 14 is too narrow. On the other hand, the limiting members 35 and 37 are very useful to prevent the articles from straying out of a desired pathway when articles are advanced at high speeds. In a more particular use of limiting members, a setting of about 0.250 inch between the undersides of the guide members 28 and 29 and the limiting members 35 and 37 is used as the articles enter bin 17. Then as the articles get to the interposing mechanism 34 the setting is tapered to a setting of about 0.050 inch between the undersides of guide members 28 and 29 and the limiting members 35 and 37.

Figure 5:
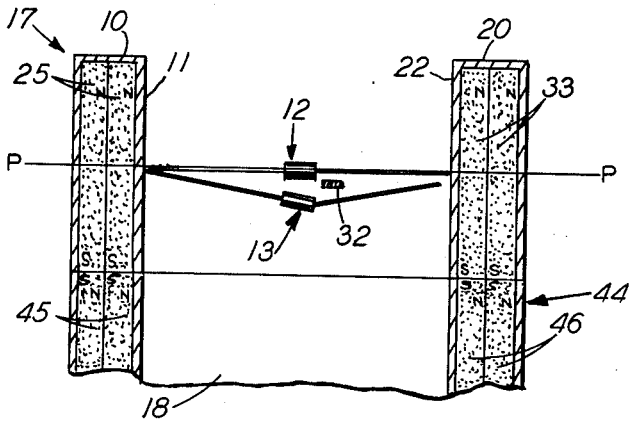
FIG. 5 is the same view as FIG. 2 except that no guide members are shown.

In an operation where only excessively bent diodes are to be detected and removed from a mass of diodes 12 and 13, another version of the invention may be used as shown in FIG. 5. The view in FIG. 5 is also the same view as shown in FIG. 2, except that the guiding means have been further modified. Note that the guide members 28 and 29 have been completely removed and the diodes 12 and 13 are permitted to orient themselves just slightly below plane P—P. In this embodiment the plane of balanced forces in the magnetic field provides the only guiding means along which the ends of the diodes 12 and 13 are advanced. Preferably, the diodes are advanced by using the force of gravity only so that uneven forces sometimes caused by air jets do not cause the diodes to bounce and stray substantially from the roughly linear guiding means theoretically existing just below plane P—P. It will be appreciated that this embodiment of the invention provides less accurate discrimination than those embodiments employing guide members 28 and 29 and/or additional members 35 and 37. However, the embodiment may be employed to inexpensively detect excessively bent devices which are known to jam some lead straighteners.

Figure 6:
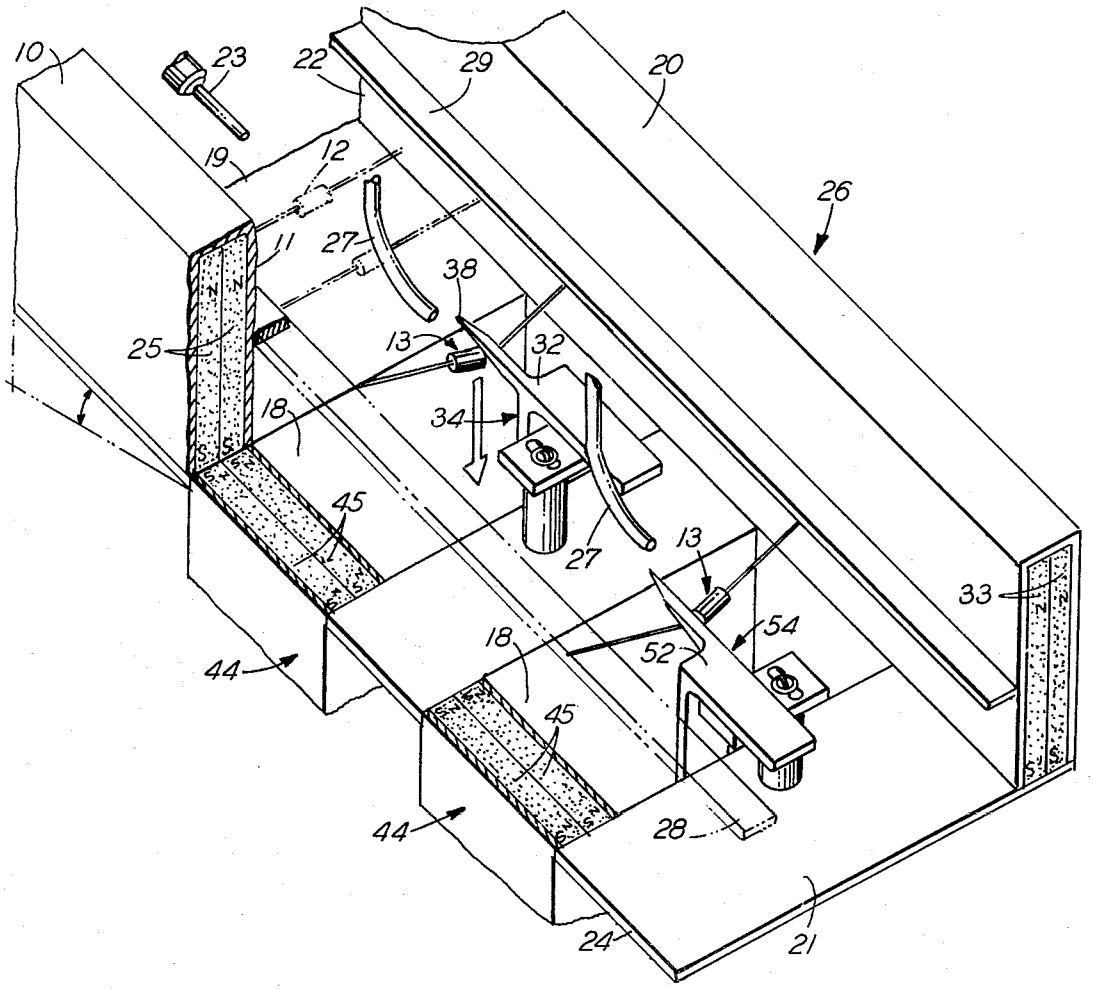
FIG. 6 is a pictorial view of a magnetic bin illustrating a further embodiment of the instant invention wherein more than one interposing member is used to separate the articles.

Referring now to FIG. 6, there is shown a pictorial view of a magnetic bin 26 including a further embodiment of the instant invention wherein more than one interposing member is used to separate elongated articles. A transposing and separating mechanism 34 is shown as before having a member 32 located on the far side and close to the body 16 of a straight diode 12 as it advances to mechanism 34. The member 32 is generally effective in detecting and removing bent diodes 13 even if a bend occurs in a lead 14 on the near side of a body 16. However, if a very fine degree of discrimination is desired, then another mechanism 54 similar to the interposing and separating mechanism 34 can be employed as shown in the figure. The additional mechanism 54 is disposed further along the pathways of diodes 12 and 13 than the first mechanism 34. The mechanism 54 is constructed in much the same manner as the mechanism 34 but it is of opposite hand. Also another exit port 18 is provided adjacent to the mechanism 54. If mechanism 34 fails to detect a bent diode 13 because of a bend in a near lead 14 then the mechanism 54 is ideally suited to intercept and remove the diode 13 having the bending in the near lead. It is believed apparent from this description that any number of interposing and separating mechanisms can be used to detect bending at various portions of an article in accordance with the teachings of this embodiment.

Figure 7:
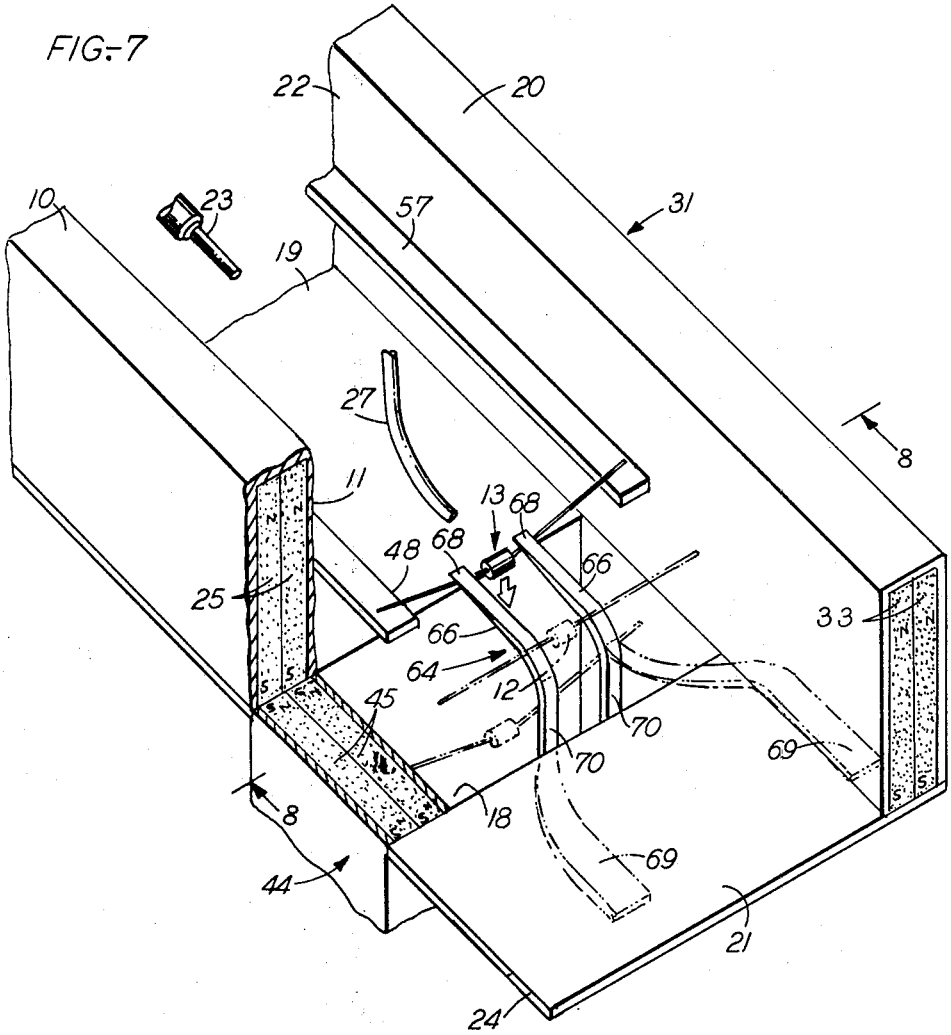
FIG. 7 is a pictorial view of a magnetic bin wherein the articles are guided along the topside of guide members and FIG. 8 is a cross-sectional view of the magnetic bin shown in FIG. 7 taken along line 8—8.

Referring now to FIG. 7, there is shown a pictorial view of a magnetic bin 31 featuring another embodiment of the invention. The bin 31 has many features which are the same as the previous bin 17; however there are also significant differences. The magnetic bin 31 is designed to have the ends of the diodes 12 and 13 guided along the top of guide members 48 and 57 as can be clearly seen in FIG. 8 which is a cross-sectional view of FIG. 7 taken along line 8—8. It can also be clearly seen in FIG. 8 that the plane P—P of balanced forces in the magnetic field is now located below the top sides of guide members 48 and 57. In this arrangement the diodes 12 and 13 are urged downward toward plane P—P by the magnetic field and by the force of gravity. The ends of the diodes 12 and 13 therefore tend to adhere to the top surfaces of the guide members 48 and 57 which are here discontinued at a mechanism 64 as shown in FIG. 7. Another difference between the magnetic bin 31, and the previous magnetic bin 17 resides in the design of the interposing and separating mechanism 64 shown in FIG. 7 and FIG. 8. The mechanism 64 includes two curved members 66, each having a support end 70 and a leading edge 68. Each of the curved members 66 is fastened to a portion of the floor member 24 of the bin 31.

In operation of the embodiment shown in FIG. 7, the diodes 12 and 13 are supported on top of the guide members 48 and 57 with the major portion of each diode suspended between the sidewalls 11 and 22. The diodes 12 and 13 are advanced through the bin either by the force of gravity or by the force of air issuing from a jet such as 23 in FIG. 1 or by both forces. As a straight diode 12 approaches the two interposing members 66 it presents a configuration which is entirely above such members 66. As the straight diode 12 further advances it drops off the ends of guide members 48 and 57 and onto the upper surfaces of the two interposing members 66. Once the straight diode 12 is transferred to the upper surface of the members 66, it is further advanced to the outlet end of the bin 31 guided only by the magnetic plane P—P. On the other hand, when a bent diode 13 advances to the area of the interposing and separating mechanism 64 it presents a configuration which falls generally below member 66. The bent diode 13 then further advances beyond the ends of the guide members 48 and 57 where it collides with the mechanism 64. The bent diode 13 strikes the curved members 66 and is deflected thereby into an exit port 18 in the floor 24 of the bin 31.

Figure 8:
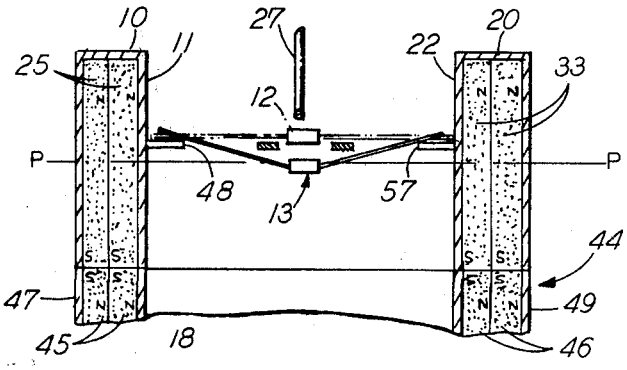

In another embodiment of the instant invention, the bin 31 shown in FIGS. 7 and 8 is used to distinguish bent articles from straight articles without a system of magnets in the side members 10 and 20. Orientation of the articles is maintained by introducing into the bin and between each article a spacing member (not shown). Such members are preferably of a flat, rectangular shape and are made of a material having a relatively low coefficient of friction. The spacing members and the diodes 12 are supported by the guide members 48 and 57 until they reach the area of the separating mechanism 64. There the diodes 12 and the spacing members transfer onto the members 66, then onto added guide members 69 and finally out of the end 21 of the bin 31. The spacing members advance through the bin 31 between successive articles thereby performing a function similar to a magnetic field in maintaining article orientation. The articles need not be magnetic to be distinguished according to their shape in the practice of this latter embodiment of the invention.

There have been illustrated herein certain practical embodiments of the invention and certain applications thereof. Nevertheless, it is to be understood that various modifications and refinements may be made and used which differ from these disclosed embodiments without departing from the spirit and scope of the instant invention.

What is claimed is:

1. A method of distinguishing elongated articles having a first shape from elongated articles having a second shape, comprising:

orienting the elongated articles transverse to a longitudinal guiding means such that the oriented articles present distinctive configurations of the first and second shapes when viewed against a plane transverse to the guiding means;

advancing the articles in succession along the guiding means such that the configurations of the first and second shapes thereby form substantially parallel pathways; and interposing at least one member in a resultant space between such parallel pathways to separate and therefore to distinguish the articles according to their shape.

2. The method of claim 1, wherein the articles are magnetic and wherein the orienting step further comprises:

successively introducing the articles between spaced sidewalls of a bin;

establishing between and transverse to said sidewalls a magnetic field of sufficient strength relative to the weight of said articles to suspend each article between the sidewalls at a position relative to a plane of balanced magnetic forces between said sidewalls.

3. The method of claim 2, wherein the advancing step further comprises:

directing at least one stream of fluid against the articles to further the advancement of the articles.

4. The method of claim 2, wherein the advancing step further comprises:

guiding the ends of the articles along the underside of guide members affixed to the sidewalls of the bin such that the underside of the guide members are lower than the plane of balanced forces in the magnetic field and the ends of the articles are urged upward against the guide members by the magnetic field.

5. The method of claim 4, wherein the advancing step further comprises:

controlling the distance over which the ends of an article can stray from the underside of the guide members as the articles are advanced by affixing a limiting member to each sidewall below and spaced from each guide member.

6. The method of claim 2, wherein the advancing step further comprises:

guiding the ends of the articles along the topside of guide members affixed to each sidewall of the magnetic bin, the topside of the guide members being higher than the plane of balanced forces in the magnet field such that the ends of the articles are urged downward against the guide members by the magnetic field.

7. The method of claim 4, wherein articles having varying degrees of an undesirable shape are distinguished from articles having a desired shape and wherein the interposing step further comprises:

positioning a detector member within the bin such that a leading edge thereof is directed toward the input end of the bin, the member tapering in a knife-like manner from a support end to the leading edge and the leading edge being adjustably positioned between the pathway formed by an article having the desired shape and the pathways of articles having varying degrees of the undesirable shape to intercept those articles which have such degree of undesirable shape as to require removal, the lower disposed portions of such undesirably shaped articles being intercepted by the detector member and such articles being deflected downward thereby into an exit port in the bottom of the bin.

8. The method of claim 7 further comprising:

receiving the downwardly deflected articles within an exit chute, the said chute having a receiving end in communication with the exit port of the bin and a pair of spaced sidewalls projecting downwardly away from the bottom of the bin;

establishing between and transverse to the sidewalls of the exit chute a magnetic field having lines of force running parallel to the lines of force in the magnetic field of the bin such that the downwardly deflected articles are attracted into the exit chute and the orientation of such articles is established transverse to the sidewalls of the exit chute.

9. The method of claim 7, wherein the interposing step further comprises:

positioning a plurality of detector members in succession between the pathways formed by the articles as they are advanced along the guides in the bin to distinguish articles having more than one type of undesirable shape.

10. The method of claim 7, wherein the interposing step further comprises:

directing at least one stream of fluid upon the area of a detector member as the articles advance thereto, to prevent the articles from adhering to the member and thereby to prevent articles from accumulating in the area.

11. Apparatus for distinguishing elongated articles having a first shape from elongated articles having a second shape, comprising:

means for orienting the elongated articles transverse to a longitudinal guiding means such that the oriented articles present distinctive configurations of the first and second shapes when viewed against a plane transverse to the guiding means;

means for advancing the articles in succession along the guiding means such that the configurations of the first and second shapes thereby form substantially parallel pathways; and means for interposing a member in a resultant space between such parallel pathways to separate and therefore to distinguish the articles according to their shape.

12. The apparatus of claim 11, wherein the articles are magnetic and wherein the orienting means further comprises:

means for successively introducing the articles between spaced sidewalls of a bin;

means for establishing between and transverse to said sidewalls a magnetic field of sufficient strength relative to the weight of said articles to suspend each article between the sidewalls at a position relative to a plane of balanced magnetic forces between said sidewalls.

13. The apparatus of claim 12, wherein the advancing means further comprises:

means for directing at least one stream of fluid against the articles to further the advancement of the articles.

14. The apparatus of claim 12, wherein the advancing means further comprises:

a member affixed to each of the sidewalls of the bin for guiding the ends of the articles along the undersides of such members such that the undersides are lower than the plane of balanced forces in the magnetic field and the ends of the articles are urged upward against the guide members by the magnetic field.

15. The apparatus of claim 14, wherein the advancing means further comprises:

a limiting member affixed to each sidewall of the bin, located below and spaced from each guide member for controlling the distance over which the ends of the article can stray from the undersides of the guide members as the articles are advanced through the bin.

16. The apparatus of claim 12, wherein the advancing means further comprises:

a member affixed to each of the sidewalls of the bin for guiding the ends of the articles along the topsides of such members such that the topsides are higher than the plane of balanced forces in the magnetic field and the ends of the articles are urged downward against the guide members by the magnetic field.

17. The apparatus of claim 14, wherein articles having varying degrees of an undesirable shape are distinguished from articles having a desired shape and wherein the interposing means further comprises:

at least one detector member positioned within the bin such that a leading edge thereof is directed toward an input end of the bin, the member tapering in a knife-like manner from a support end to the leading edge and the leading edge being adjustably positioned between the pathway formed by an article having the desired shape and the pathways of articles having varying degrees of an undesirable shape to intercept those articles having such a degree of undesirable shape as to require removal, the lower disposed portions of such undesirably shaped articles being intercepted by the detector member and such articles being deflected downward thereby into an exit port in the bottom of the bin.

18. The apparatus of claim 17 further comprising:

an exit chute having a receiving end in communication with the exit port of the bin and a pair of spaced sidewalls projecting downwardly away from the bottom of the bin;

means for establishing between and transverse to the sidewalls of the exit chute a magnetic field having lines of force running parallel to the lines of force in the magnetic field of the bin such that the downwardly deflected articles are attracted into the exit chute and the orientation of such articles is established transverse to the sidewalls of the exit chute.

19. The apparatus of claim 17, wherein the interposing means further comprises:

a plurality of detector members positioned in succession between the pathways formed by the articles as they are advanced along the guides in the bin to distinguish articles having more than one type of undesirable shape.

20. The apparatus of claim 17, wherein the interposing means further comprises:

means for directing at least one stream of fluid upon the area of a detector member as the articles advance thereto, to prevent the articles from adhering to the member and thereby to prevent articles from accumulating in the area.

* * * * *